US009307324B2

(12) United States Patent
Onishi et al.

(10) Patent No.: US 9,307,324 B2
(45) Date of Patent: Apr. 5, 2016

(54) SPEAKER

(71) Applicant: NEC CASIO MOBILE COMMUNICATIONS, LTD., Kanagawa (JP)

(72) Inventors: Yasuharu Onishi, Kawasaki (JP); Jun Kuroda, Kawasaki (JP); Shigeo Satou, Kawasaki (JP); Motoyoshi Komoda, Kawasaki (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 14/396,756

(22) PCT Filed: Dec. 4, 2012

(86) PCT No.: PCT/JP2012/007751
§ 371 (c)(1),
(2) Date: Oct. 24, 2014

(87) PCT Pub. No.: WO2013/160975
PCT Pub. Date: Oct. 31, 2013

(65) Prior Publication Data

US 2015/0098594 A1 Apr. 9, 2015

(30) Foreign Application Priority Data

Apr. 27, 2012 (JP) ..... 2012-102415

(51) Int. Cl.
*H04R 25/00* (2006.01)
*H04R 15/00* (2006.01)
(Continued)

(52) U.S. Cl.
CPC ..... *H04R 15/00* (2013.01); *H04R 1/403* (2013.01); *H04R 3/00* (2013.01); *H04R 2201/401* (2013.01); *H04R 2217/03* (2013.01)

(58) Field of Classification Search
CPC ..... H04M 1/026; H04R 15/00; H04R 3/00
USPC ..... 381/190, 191
See application file for complete search history.

(56) References Cited

U.S. PATENT DOCUMENTS 2,421,263 A 5/1947 Herbst
8,027,488 B2 9/2011 Pompei
(Continued)

FOREIGN PATENT DOCUMENTS

JP 2004-297726 10/2004
JP 2004297726 A * 10/2004
(Continued)

OTHER PUBLICATIONS

F.Claeyysen,N. Lhermet, T. Maillard ("Magnetostrictive Actuators compared to Piezoelectric Actuators",2002).*
(Continued)

*Primary Examiner* — Sunita Joshi
(74) *Attorney, Agent, or Firm* — Young & Thompson

(57) ABSTRACT

A plurality of magnetostrictive elements made of ferrite or the like are arranged in a matrix on an upper surface of a circuit board. On the periphery of each of the magnetostrictive elements, a voice coil is arranged. When current flows to the voice coils, the magnetostrictive elements themselves expand and contract in their center axis direction (height direction), and whereby ultrasonic waves (carrier waves) are emitted into the air from the magnetostrictive elements themselves. Since the magnetostrictive elements made of ferrite or the like are used, power consumption can be reduced, compared with the case of using piezoelectric vibrators. Also, the magnetostrictive elements can be made resistant to damage even if subjected to an impact due to falling or the like. Accordingly, in a parametric speaker using ultrasonic waves as carrier waves, power consumption can be reduced and vibrating elements can be made resistant to impact damage.

4 Claims, 1 Drawing Sheet

(51) Int. Cl.
*H04R 1/40* (2006.01)
*H04R 3/00* (2006.01)

(56) References Cited

U.S. PATENT DOCUMENTS

| | | | | |
|---|---|---|---|---|
| 8,305,074 | B2 | 11/2012 | Lee et al. | |
| 2005/0248233 | A1* | 11/2005 | Pompei | 310/322 |
| 2006/0233404 | A1 | 10/2006 | Croft et al. | |
| 2010/0321009 | A1 | 12/2010 | Lee et al. | |
| 2012/0051556 | A1 | 3/2012 | Pompei | |

FOREIGN PATENT DOCUMENTS

| | | |
|---|---|---|
| JP | 2006-245731 | 9/2006 |
| JP | 2010-051039 | 3/2010 |
| JP | 2012-029102 | 2/2012 |

OTHER PUBLICATIONS

International Search Report—PCT/JP2012/007751—Jan. 15, 2013.
Extended European Search Report dated Nov. 6, 2015; Application No. 12875465.2.

* cited by examiner

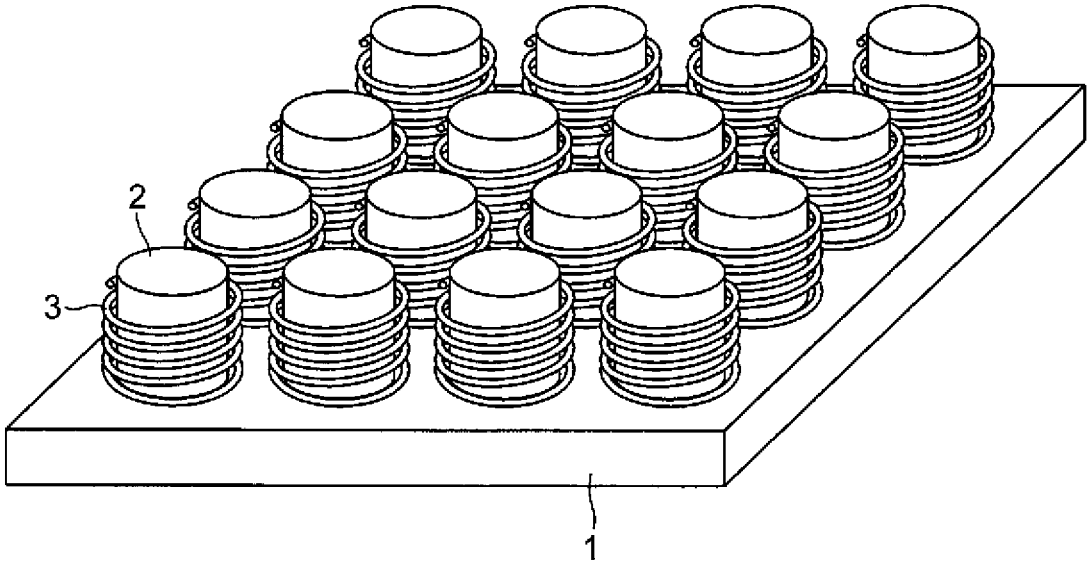
2
3
1

SPEAKER

CROSS-REFERENCE TO RELATED APPLICATIONS

This is a national stage of International Application No. PCT/JP2012/007751 filed Dec. 4, 2012, claiming priority based on Japanese Patent Application No. 2012-102415 filed Apr. 27, 2012, the entire contents of which are incorporated herein by reference.

TECHNICAL FIELD

The present invention relates to a speaker.

BACKGROUND ART

In conventional speakers, there is a speaker that uses ultrasonic waves as carrier waves called a parametric speaker (for example, refer to Patent Document 1). In the speaker described in Patent Document 1, a plurality of piezoelectric vibrators each having a piezoelectric element are arranged in a matrix, and modulated ultrasonic waves (carrier waves) are emitted into the air from the respective piezoelectric vibrators. With these emitted ultrasonic waves subjected to a non-linear phenomenon of air, a demodulated audible sound is generated.

PRIOR ART DOCUMENT

Patent Document

Patent Document 1: JP 2012-029102

SUMMARY OF INVENTION

Problem to be Solved by the Invention

However, in the conventional speaker described above, since piezoelectric vibrators are used as a source for generating ultrasonic waves, the amount of current consumption under certain circumstances, which will be described further below, disadvantageously increases due to characteristics of the piezoelectric elements of the piezoelectric vibrators, and whereby power consumption increases. Moreover, when a ceramic material, which is a brittle material, is used for piezoelectric elements, the piezoelectric elements may be damaged when subjected to an impact due to falling or the like.

Thus, an object of the present invention is to provide a speaker capable of reducing power consumption under certain circumstances and also making vibrating elements resistant to damage even if subjected to an impact due to falling or the like.

Means for Solving the Problem

A speaker according to the present invention is characterized by comprising a circuit board, a plurality of magnetostrictive elements arranged on the circuit board, and voice coils arranged on respective peripheries of the plurality of magnetostrictive elements.

Effect of the Invention

According to the present invention, power consumption under certain circumstances can be reduced. Also, the magnetostrictive elements, which are vibrating elements, can be made resistant to damage even if subjected to an impact due to falling or the like.

BRIEF DESCRIPTION OF DRAWING

The drawing is a perspective view of main section of a speaker as one embodiment of the present invention.

DESCRIPTION OF EMBODIMENTS

The drawing is a perspective view of main section of a speaker as one embodiment of the present invention. This speaker includes a circuit board 1. At a plurality of locations on an upper surface of the circuit board 1, lower surfaces of a plurality of columnar-shaped magnetostrictive elements 2 made of ferrite or the like are fixed via an adhesive, respectively (not depicted in the drawing). That is, each of the magnetostrictive elements 2 is provided on the circuit board 1 so that a center axis thereof is perpendicular to the circuit board 1.

The magnetostrictive elements 2 are arranged in a four-by-four matrix, as an example. Also, as an example, the outer diameter of each of magnetostrictive elements 2 is approximately 10 mm. On the respective peripheries of the magnetostrictive elements 2, voice coils 3 are arranged. A lower portion of each of the voice coils 3 is fixed to the upper surface of the circuit board 1 via an adhesive (not depicted in the drawing).

In this speaker, when current flows to the voice coils 3, the magnetostrictive elements 2 themselves expand and contract in their center axis direction (height direction). When the magnetostrictive elements 2 themselves expand and contract in their center axis direction, ultrasonic waves in a band equal to or higher than a frequency of 20 kHz are generated. Then, when modulated ultrasonic waves (carrier waves) are emitted into the air from the magnetostrictive elements 2, these emitted ultrasonic waves are subjected to a non-linear phenomenon of air, and whereby a demodulated audible sound is generated.

In this speaker, since the magnetostrictive elements 2 made of ferrite or the like are used, the magnetostrictive elements 2 can be made resistant to damage even if subjected to an impact due to falling or the like, compared with piezoelectric vibrators using a ceramic material, which is a brittle material, as piezoelectric elements. Also, in this speaker, since the magnetostrictive elements 2 themselves vibrate, a dedicated vibrating plate is not required, and whereby the miniaturization and thinning of the speaker can be achieved.

Here, directivity in a parametric speaker is determined by straight-traveling property of carrier waves (ultrasonic waves). In the case of piezoelectric vibrators having piezoelectric elements, directivity becomes sharper as a shift is made to a higher frequency band. However, impedance decreases due to characteristics of the piezoelectric elements, the amount current consumption increases, and power consumption increases. By contrast, in this speaker, since the magnetostrictive elements 2 made of ferrite or the like are used, impedance does not change even if a shift is made to a higher frequency band. Accordingly, the amount of current consumption does not increase and power consumption can be reduced, compared with the case of piezoelectric vibrators having piezoelectric elements.

Also, in this speaker, directivity can be easily controlled. That is, since the magnetostrictive element 2 has a fundamental resonance frequency, directivity can be easily controlled by adjusting the fundamental resonance frequency of each of the plurality of magnetostrictive elements 2 arranged in a matrix and arbitrarily changing the magnetostrictive elements 2 to be driven. As a result, directivity can be easily adjusted according to the use environment of the user.

As a method of adjusting the fundamental resonance frequency of the magnetostrictive element 2, since the thickness (height), the outer shape, and the like of the magnetostrictive element 2 can be taken as determining factors for the fundamental resonance frequency, these may be adjusted as appropriate. For example, the fundamental resonance frequency is reduced when the thickness of the magnetostrictive element 2 is made thinner. Also, the fundamental resonance frequency is reduced when the outer diameter of the magnetostrictive element 2 is increased.

Furthermore, in this speaker, when a plurality of ultrasonic waves with different frequencies are emitted from the plurality of magnetostrictive elements 2, the band of an audible sound is expanded due to interference of the ultrasonic waves with different frequencies, and whereby sound pressure is amplified. Accordingly, the quality of the audible sound can be enhanced.

Hereinafter, several embodiments of this invention are summarized in the Supplementary Notes described below.

(Supplementary Note 1)

The invention of Supplementary Note 1 provides a speaker comprising a circuit board, a plurality of magnetostrictive elements arranged on the circuit board, and voice coils arranged on respective peripheries of the plurality of magnetostrictive elements.

(Supplementary Note 2)

The invention of Supplementary Note 2 provides the speaker according to Supplementary Note 1, wherein each of the magnetostrictive elements has a columnar shape, and is provided on the circuit board so that a center axis thereof is perpendicular to the circuit board.

(Supplementary Note 3)

The invention of Supplementary Note 3 provides the speaker according to Supplementary Note 1, wherein the magnetostrictive elements are arranged in a matrix.

(Supplementary Note 4)

The invention of Supplementary Note 4 provides the speaker according to Supplementary Note 1, wherein the plurality of magnetostrictive elements has different fundamental resonance frequencies.

DESCRIPTION OF REFERENCE NUMERALS

1 Circuit board
2 Magnetostrictive element
3 Voice coil

The invention claimed is:

1. A speaker comprising:

a circuit board, a plurality of magnetostrictive elements arranged on the circuit board, and voice coils arranged on respective peripheries of the plurality of magnetostrictive elements, wherein each of the magnetostrictive elements has a columnar shape and is directly fixed on the circuit board so that a center axis thereof is perpendicular to the circuit board, and wherein a lower portion of each of the voice coils is fixed to an upper surface of the circuit board with an adhesive.

2. The speaker according to claim 1, wherein the magnetostrictive elements are arranged in a matrix.

3. The speaker according to claim 1, wherein the plurality of magnetostrictive elements has different fundamental resonance frequencies.

4. The speaker according to claim 1, wherein a top surface of each of the magnetostrictive elements is uncovered and arranged to emit ultrasonic waves directly into air, and does not have a vibrating plate attached to the top surface.

* * * * *